US006234921B1

(12) United States Patent
Davis et al.

(10) Patent No.: US 6,234,921 B1
(45) Date of Patent: May 22, 2001

(54) SPORTS RACQUETS WITH TRIPOD WEIGHTING

(75) Inventors: Stephen J. Davis, Washington Crossing; Brian J. Blonski, Yardley, both of PA (US); Joseph J. Wolverton, Lawrenceville, NJ (US)

(73) Assignee: Benetton Sportsystem USA, Inc., Bordentown, NJ (US)

( * ) Notice: Subject to any disclaimer, the term of this patent is extended or adjusted under 35 U.S.C. 154(b) by 0 days.

(21) Appl. No.: 09/305,768

(22) Filed: May 5, 1999

(51) Int. Cl.[7] ..... A63B 49/02

(52) U.S. Cl. ..... 473/537; 473/535; 473/536; 473/544

(58) Field of Search ..... 473/524, 537, 473/519, 535, 536, 544, 547

(56) References Cited

U.S. PATENT DOCUMENTS

| | | | | |
|---|---|---|---|---|
| Re. 33,372 | | 10/1990 | Frolow . | |
| 1,539,019 | | 5/1925 | Nikonow . | |
| 4,153,249 | * | 5/1979 | Plagenhoef | 473/537 |
| 4,165,071 | | 8/1979 | Frolow . | |
| 4,997,186 | * | 3/1991 | Carr | 473/537 |
| 5,220,719 | * | 6/1993 | You | 473/544 X |
| 5,299,801 | * | 4/1994 | Sol et al. | 473/537 |
| 5,310,179 | * | 5/1994 | Takatsuka | 473/537 |
| 5,462,274 | * | 10/1995 | Takatsuka | 473/537 |
| 5,913,740 | * | 6/1999 | Miklos | 473/537 |

FOREIGN PATENT DOCUMENTS 9-215780 * 8/1997 (JP) .

OTHER PUBLICATIONS

P. 95, Tennis Magazine, Jun. 1991, showing Wilson Pro Staff 6.0 si 110 Tennis Racquet wit "perimeter weighting a the sides of the head".

* cited by examiner

*Primary Examiner*—Raleigh W. Chiu
(74) *Attorney, Agent, or Firm*—Skadden, Arps, Slate, Meagher & Flom LLP

(57) ABSTRACT

A sports racquet has a lightweight frame and a pair of pods, having an increased cross-sectional width, at the 11 o'clock and 1 o'clock positions of the head. The pods also preferably have an increased wall thickness, or a molded-in weight element, so as to provide increased weight at such regions,. Preferably also, the handle has at least one weight pod at the butt portion. The three pod weighting system, i.e., having weight pods located at the 11 o'clock, 1 o'clock, and butt end positions, not only increases the polar moment of inertia of the racquet about its longitudinal axis, but also increases the moment of inertia of the racquet about the center of gravity, providing a very stable racquet. Also, because the pods in the head portion increase the width of the frame, the torsion of the frame near the tip region is greatly increased, improving the power of the racquet with respect to balls hit further out on the string bed. In a preferred embodiment, the weight pods are formed of metal coated carbon fibers.

21 Claims, 7 Drawing Sheets

SPORTS RACQUETS WITH TRIPOD WEIGHTING

BACKGROUND OF THE INVENTION

The present invention relates to sports racquets having strings, for example, tennis racquets, squash racquets, badminton racquets, and racquetball racquets.

Aside from strength and durability, weight and weight distribution have always been among the most important physical characteristics in a sports racquet. Tennis is a collision sport, as are other racquet sports, and the momentum and inertia of a racquet upon ball impact are directly related to the power and sweet spot size.

Over the past fifteen years, the speed of the game has changed with bigger, more powerful players resulting in higher ball speeds However, the mass of the ball and court size have remained the same, resulting in shorter rallies and higher impact loads imparted by the ball to the racquet. Over this same time period, due to improvements in materials and manufacturing technology, racquet weights have decreased drastically. In the case of tennis racquets, racquet weights have decreased by over 140 grams, from a typical strung weight of 360 grams to present day strung weights as low as 220 grams.

Lighter racquets tend to be more maneuverable and thus, in such respect, would appear to be better suited to a faster game. However, lighter racquets are less stable, which has a doubly negative effect in the case of any balls which do not land exactly at the racquet's center of mass. First, the racquet tends to twist, either about the longitudinal axis (in the case of balls which land off-axis), or about the center of mass (or both), more than a heavier racquet hitting the same ball. Second, because faster ball speeds mean greater impact momentum, the twisting force will be magnified compared to a heavier racquet. Thus, lighter racquets tend to be harder to control, and for such reason, professional tennis players continue to use heavier racquets.

In the past, proposals have been made to improve the stability of the racquet. For example, Wilson Sporting Goods markets racquets with a "Perimeter Weighting System", in which small weights are placed at the 3 o'clock and 9 o'clock locations on the racquet head. These weights increase the polar moment of inertia, and thereby improve the resistance to twisting on side-to-side off center hits, but do not improve the stability about the racquet's midpoint.

Nikonow U.S. Pat. No. 1,539,019 discloses a racquet which uses a lightweight handle and in which weight is shifted to the tip region in order to advance the location of the center of percussion. Removing weight from the handle and shaft, and shifting such weight to the head, has two disadvantages. First, the racquet becomes head heavy and thus less maneuverable. Second, the longitudinal stability of the racquet about its midpoint is reduced. Thus, when balls land on the string bed above or below the center of percussion of the racquet, the handle will have a greater tendency to kick out of or towards, respectively, the player's hand. In addition, this weight distribution does not improve the polar moment of inertia of the racquet.

Other companies have tried various weight distribution schemes, all with certain drawbacks.

SUMMARY OF THE INVENTION

The present invention is a sports racquet with improved bi-directional stability, i.e., both about the longitudinal axis (for off-axis hits) and about the center of percussion (for balls hit above or below the center of percussion). The racquet also has improved power for balls hit towards the tip portion of the string bed.

More particularly, a sports racquet according to the invention has a lightweight frame and a pair of pods, having an increased cross-sectional width and perimeter, at the 11 o'clock and 1 o'clock positions of the head. The pods also preferably have an increased wall thickness, or a molded-in weight element, so as to provide increased weight at such regions, Preferably also, the handle has at least one weight pod at the butt portion. The three pod weighting system, i.e., having weight pods located at the 11 o'clock, 1 o'clock, and butt end positions, not only increases the polar moment of inertia of the racquet about its longitudinal axis, but also increases the moment of inertia of the racquet about the center of gravity, providing a very stable racquet. Also, because the pods in the head portion increase the width of the frame, the torsion and rigidity of the frame near the tip region is greatly increased, improving the power of the racquet with respect to balls hit further out on the string bed.

The weight pods at the 11 o'clock and 1 o'clock locations do several things. First, they improve the polar moment of inertia. Second, they improve the longitudinal mass moment of inertia about the midpoint of the racquet. Third, they raise the center of percussion and vibrational node higher in the head of the racquet, i.e., towards the tip, which improves performance in this area.

The weight at the butt end also does several things. First, it improves the longitudinal mass moment of inertia about its midpoint. Improving this property improves the stability of the racquet for balls hit above and below the center of percussion. Second, adding weight to the racquet in the butt increases the overall momentum of the racquet upon ball impact and therefore energy transfer to the ball. It does this without increasing the swing weight of the racquet because of its location in the butt.

The amount of the weights at each weight pod is preferably between 3 and 30 grams. Preferably, the weight pod in the butt has greater weight than either of the two pods in the head portion. Preferably, the weight of the pod in the butt equals the combined weight of the two head weight pods Such weights can be provided by using more material, e.g., carbon or glass fiber, at the pod locations, or by adding a weight element such as steel, lead, or titanium.

Alternatively, in another preferred embodiment, the pods in the head portion are formed by applying a resin-impregnated braided or woven sleeve, or a flat piece of material of such braided or woven material, over the outer surface of the uncured frame tube. The braid or woven material becomes an integral part of the frame as a result of the pressure molding process. The sleeve or other material is comprised of metal coated carbon fibers or glass fibers, respectively, which have a higher density than uncoated carbon or glass fibers. Preferably, the metal material is nickel, copper, brass, or titanium. This alternative has the advantage of increasing weight while maintaining the stiffness of the carbon fiber composite or the strength of the glass fiber composite, respectively.

In the butt, such weight element can be molded into the graphite frame material or molded into the plastic butt cap. Alternatively, the butt cap can be molding out of a plastic containing a heavy metal powder so as to increase the density of the plastic.

For a better understanding of the invention, reference is made to the following detailed description of a preferred embodiment, taken in conjunction with the drawings accompanying the application.

DETAILED DESCRIPTION OF PREFERRED EMBODIMENTS

Figure 1:
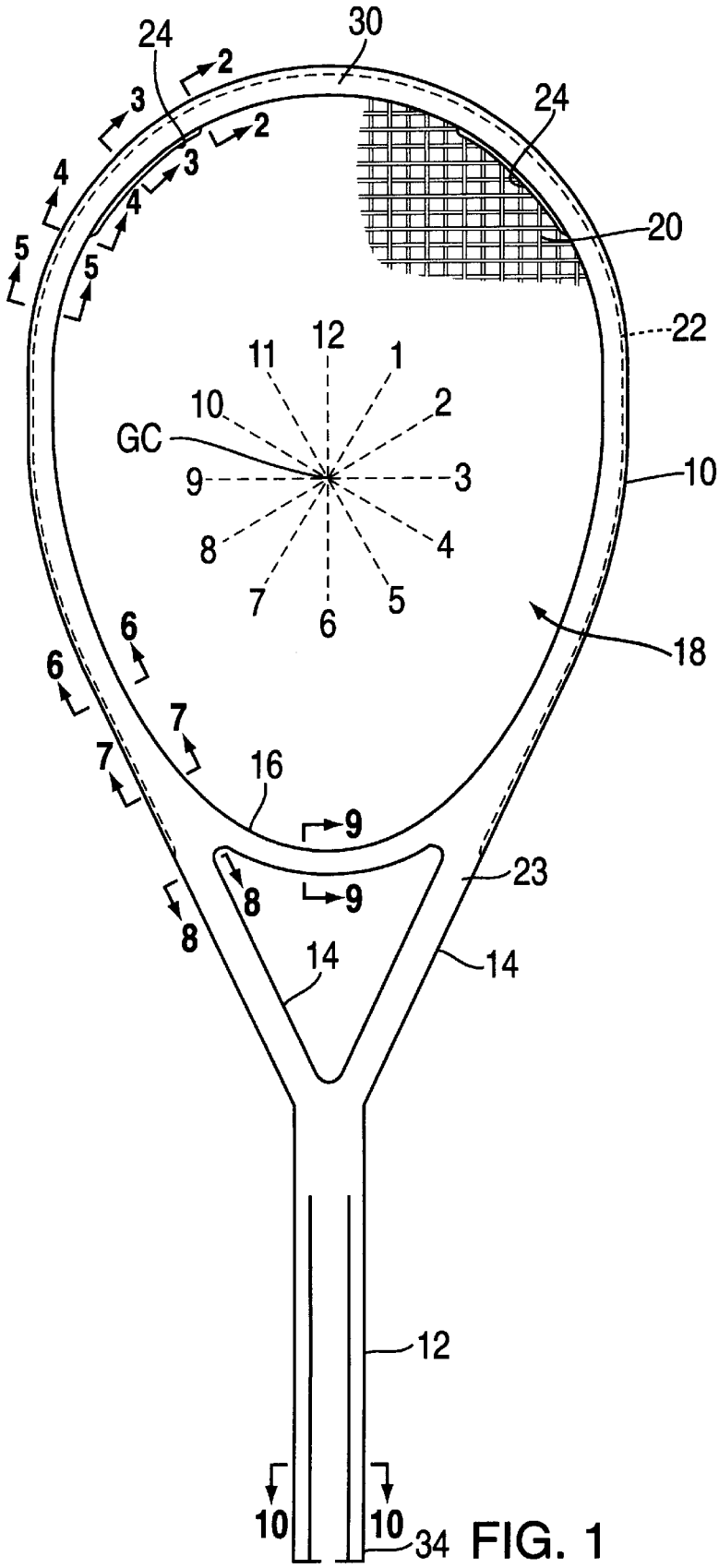
FIG. 1 is a plan view of a tennis racquet frame according to the invention.
Figure 2:
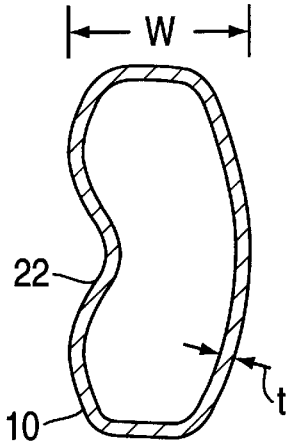
FIGS. 2–10 are sectional views of the racquet of FIG. 1, taken through lines 2—2 through 10—10, respectively.

Referring to the embodiment of FIGS. 1–11, a tennis racquet includes a hollow frame forming a head portion 10 and a handle portion, connected by a pair of shaft portions 14. A bridge portion 16 spans the lower part of the head portion to complete a stringing area 18 containing a plurality of interwoven strings 20. The head portion 10 is provided with an outwardly facing stringing groove 22 in the customary manner.

Figure 3:
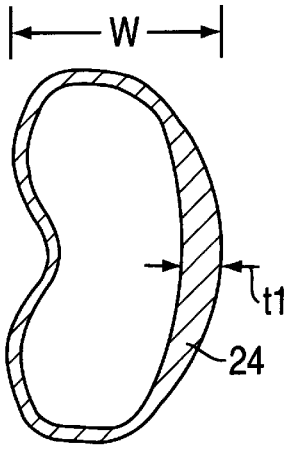
Figure 4:
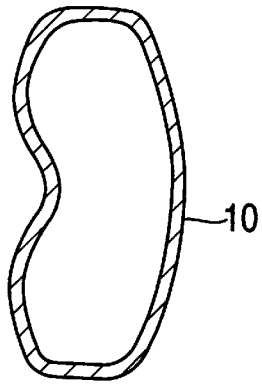
Figure 5:
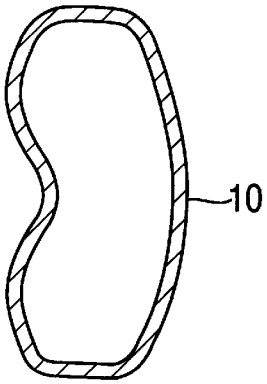
Figure 6:
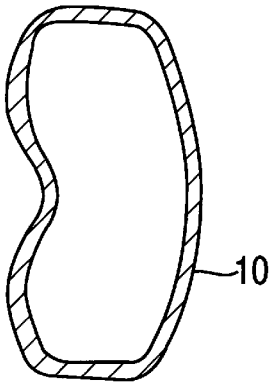
Figure 7:
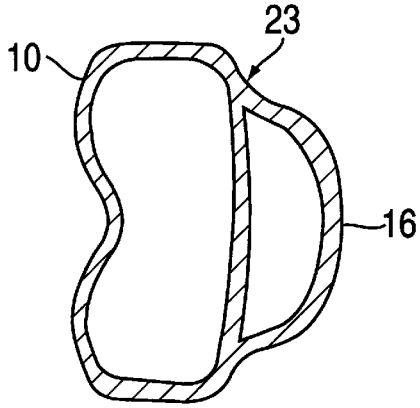
Figure 10:
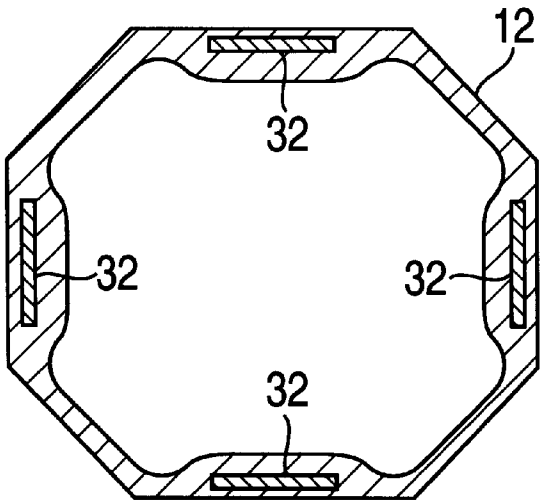
Figure 9:
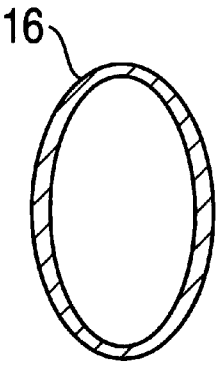
Figure 8:
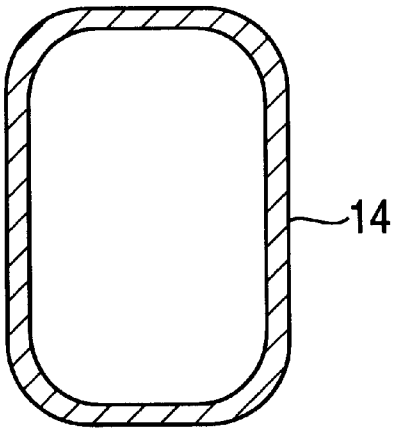

As shown in FIGS. 2–10, the frame, which is preferably carbon fiber-reinforced epoxy (so-called "graphite") or carbon fiber-reinforced thermoplastic, has a relatively small wall thickness "t", so as to have the minimum weight-per-unit-length needed to provide adequate weight and stiffness, except at the locations shown in FIGS. 3 and 10. Preferably, the frame has an aerodynamic shape, in which the cross-sectional height "h" is greater than the cross-sectional width "w", in the head portion 10, and morphs to a boxy cross section, shown in FIG. 8, in the shaft portions 14, as disclosed in commonly owned U.S. Pat. No. 5,810,683. As shown in FIGS. 6–8, from just above the throat joint 23, the frame begins to get wider and shorter in height "h", until it is transformed to the box shape in the shaft region.

A racquet frame according to the invention may be made according to any known process. In an exemplary process, sheets of uncured epoxy resin, containing unidirectional, embedded graphite fibers, are wrapped to form a hollow flexible tubular layup, or prepreg, which is placed in a mold in the shape of the frame. An inflatable bladder inside the tube is then inflated, so that the prepreg assumes the shape of the mold, and the mold is heated to cure the epoxy or other resin.

The handle portion 12 is preferably a so-called molded-in handle, in which the graphite prepreg material, in the handle portion, is molded into an octagonal shape with an outer dimension corresponding to the desired handle size. In the example shown, the handle is hollow. This can be done either by initially molding two graphite tubes side-by-side, and then removing the interior wall, or by providing a separate prepreg tube in the mold for the handle section. Alternatively, if desired, the center wall can remain.

Figure 11:
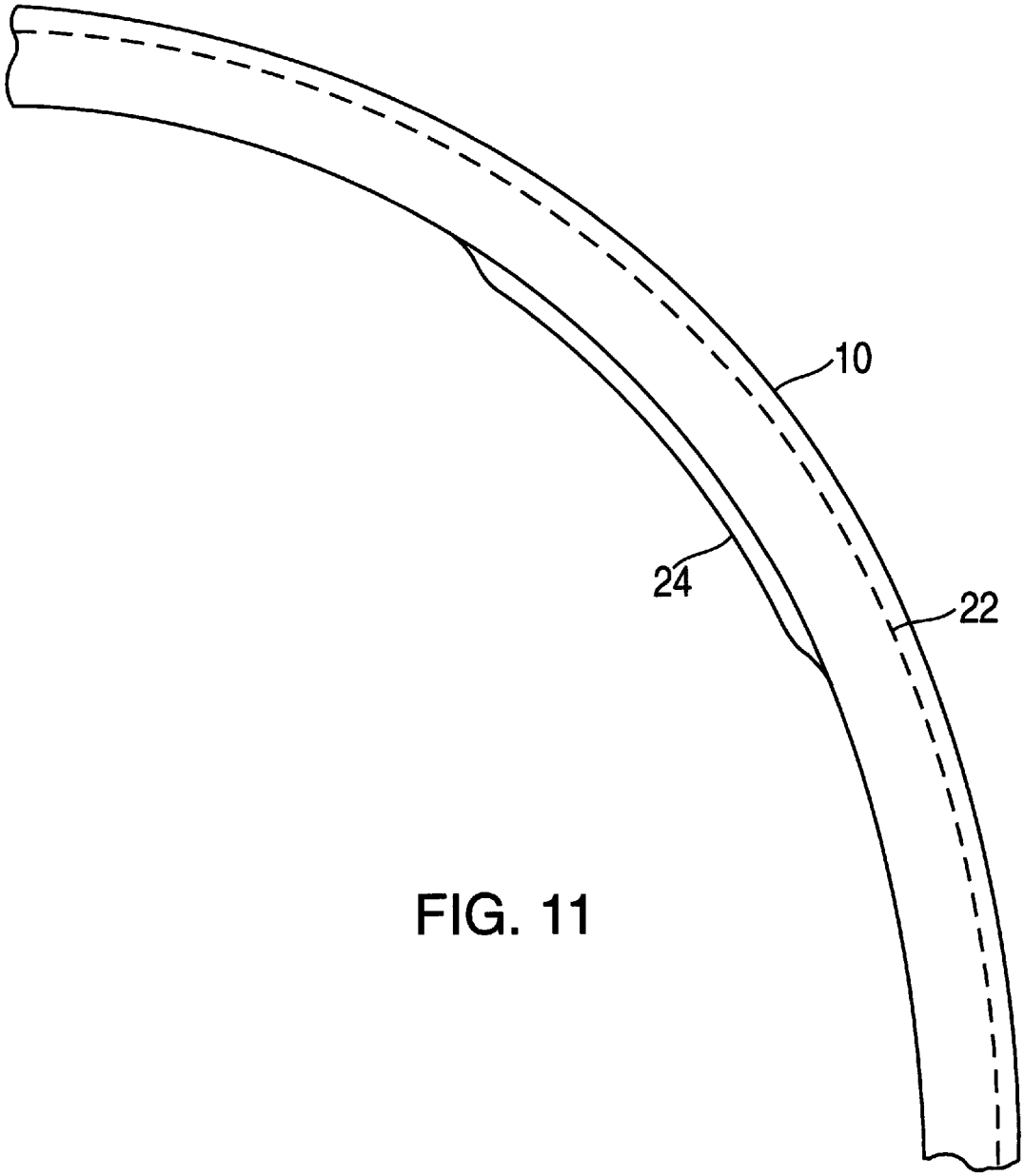
FIG. 11 is a full size view of the upper right hand comer of FIG. 1.

FIG. 1 also illustrates the geometric center "GC" of the racquet face (stringing area 18), with a clock face for reference. The tip 30 of the racquet lies at the 12 o'clock position, whereas the center of the throat bridge 16 lies at the 6 o'clock position. As shown in FIGS. 1 and 11, a pair of weight pods 24 are provided at the 11 o'clock and 1 o'clock positions, and extend for a distance of approximately 65 mm. As shown in FIG. 3, the weight pods 24 increase the cross-sectional width "w" of the frame compared with the width of the frame to either side of the weight pod 24. This increase in width means that the cross-section is rounder at the weight pod location, increasing the resistance of the frame to twisting. This is desirable because, in the tip region, ball impact is carried mostly as torsional, rather than bending, load.

In the example shown, the wall thickness "t1" of the wall facing the stringing area 18 is increased in the pod 24, by providing extra graphite material. Enough extra material is provided to increase the weight, compared to the same length of frame with no weight pod, between 3 and 30 grams, most preferably about 7 grams.

Referring to FIG. 10, which shows the handle in particular at the butt end location, a plurality of weight elements 32 are molded into the graphite material of the frame in a known manner, so as to add between 3 and 30, most preferably about 15 grams, of weight immediately adjacent the butt end, and thus form a third weight pod. As an alternative to molded-in weights, added material can be provided as in the case of weight pods 24. Alternatively, the weight pod can be provided on or in a conventional butt cap (not shown), which fits over the butt end of the handle. Examples include attaching a weight to the butt cap and mixing a metal powder in the mold with the plastic forming the butt cap.

Figure 12:
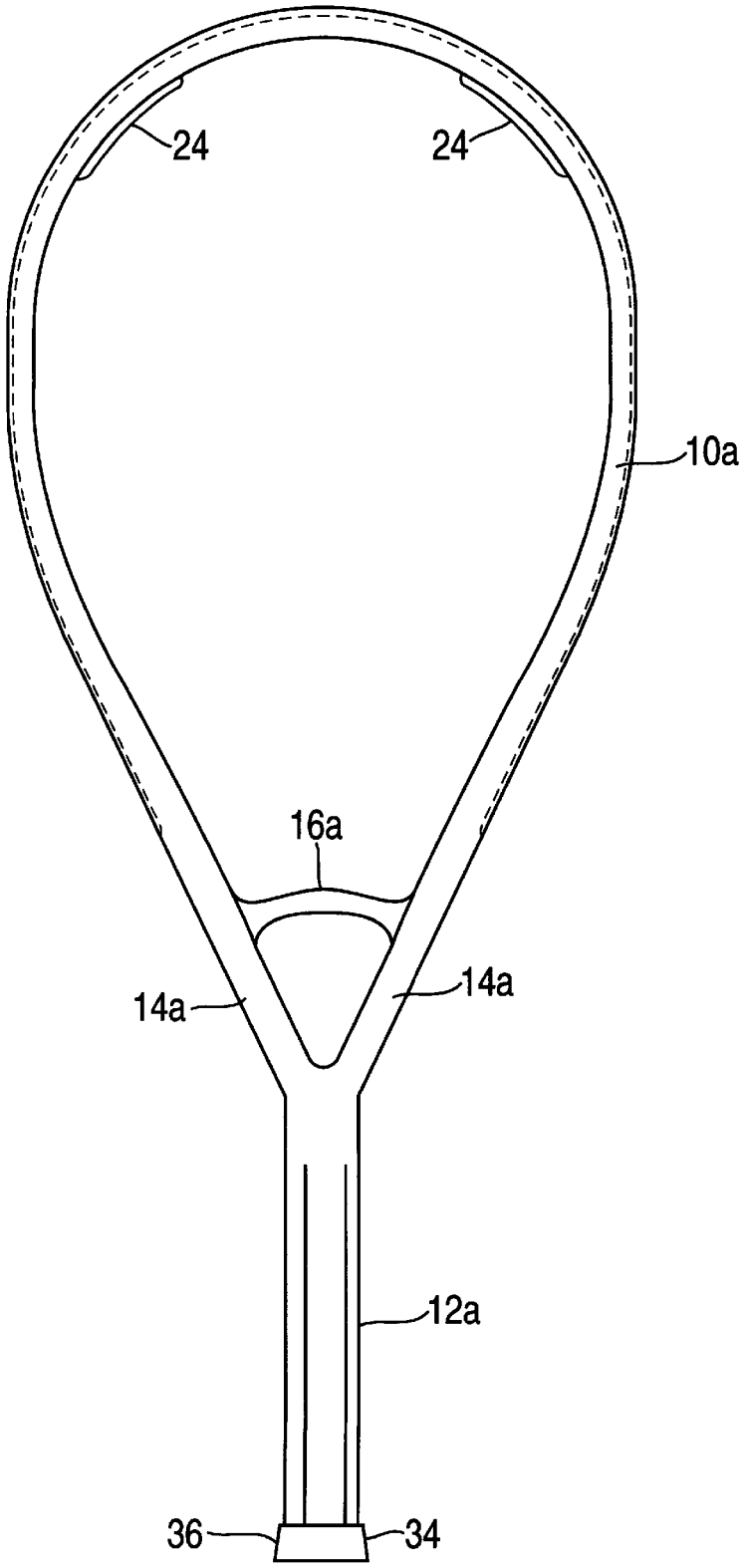
FIG. 12 is a plan view of an alternative embodiment of a tennis racquet according to the invention.

FIG. 12 shows an alternative embodiment of a tennis racquet having a pair of weight pods 24 at the 11 o'clock and 1 o'clock positions. Also, instead of a throat bridge, the racquet includes a power ring 16*a*, as disclosed in commonly owned U.S. Pat. No. 5, 562,283. As described in the '283 patent, rather than anchoring the lower ends of the main strings in string holes in the throat bridge, the lower ends of the main strings 16*a* wrap around the power ring, which has a circular cross-section, and diverge in a fan-shape pattern towards the tip. Preferably, the racquet shown in FIG. 12 also includes a third weight pod in the butt end 34, either in the frame itself or in the butt cap 36.

Figure 13:
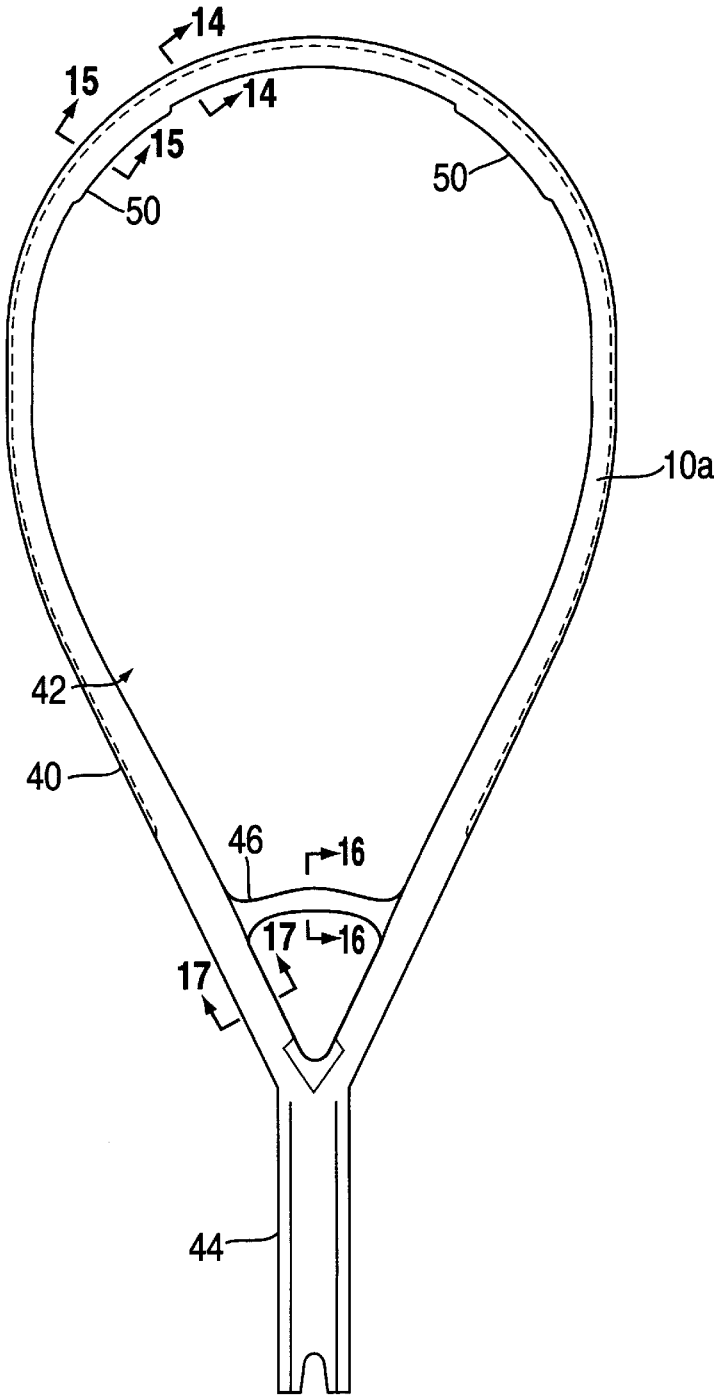
FIG. 13 is a plan view of a racquetball racquet according to the invention.
Figure 14:
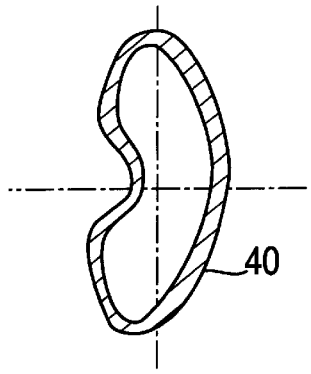
FIGS. 14–17 are sectional views of the racquet shown in FIG. 13, taken through lines 14—14 through 17—17, respectively.
Figure 15:
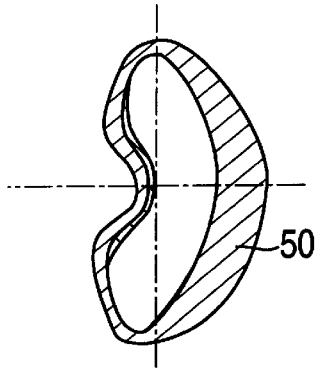
Figure 16:
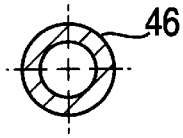
Figure 17:
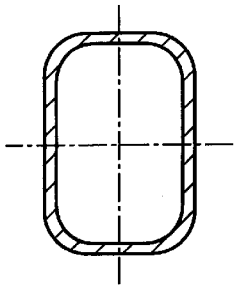

FIG. 13 shows an example of a racquetball racquet, having a head portion 40 forming a stringing area 42, a handle 44, and a power ring 46 for anchoring the lower ends of the main strings. The racquet includes a pair of weight pods 50, at the 11 o'clock and 1 o'clock positions, respectively. As shown in FIG. 15, the added weight can be provided by including additional layers of graphite material.

Figure 18:
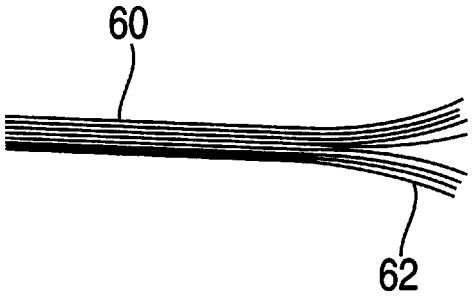
FIG. 18 shows a tow formed of a plurality of metal coated carbon fibers, as used to form the weight pods in an alternative embodiment of the invention.
Figure 21:
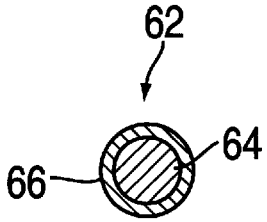
FIG. 21 is a cross-sectional view of a metal coated carbon fiber as used in the embodiment of FIGS. 18–21.

FIG. 18 shows a tow 60 formed of a plurality of metal coated fibers 62, one of which can be seen in FIG. 21. As shown in FIG. 21, the fiber 62 includes a core 64, which is preferably a carbon fiber, and an outer metal coating 66. Preferably, the outer metal coating 66 is nickel, copper, brass, or titanium. Carbon fibers, on which a thin layer of nickel or copper has been deposited, are marketed by Composite Materials, L.L.C., Mamaroneck, N.Y., under the product name "Metal Coated Graphite". Such fibers have a density of 2.81 g/cc, in contrast to uncoated carbon fibers, which have a density of 1.78 g/cc.

Figure 19:
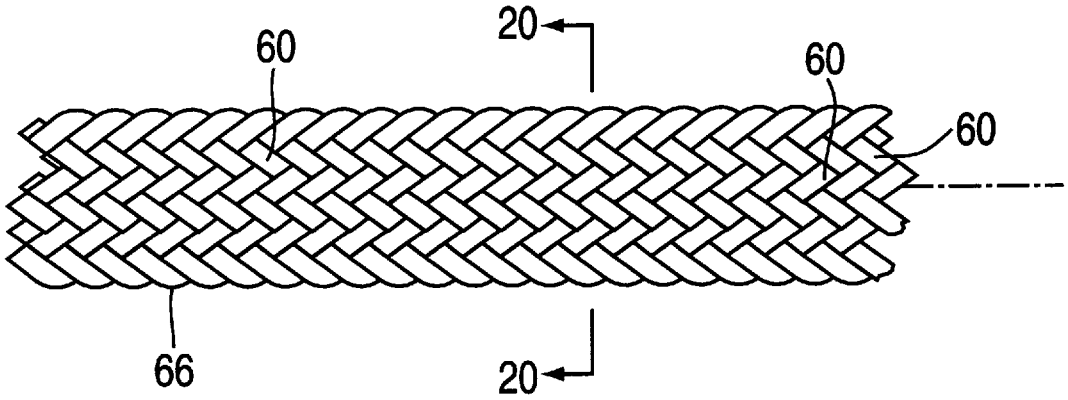
FIG. 19 shows a tubular braid formed of a plurality of tows of metal coated fibers.
Figure 20:
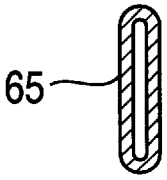
FIG. 20 is a sectional view of the tubular braid of FIG. 19, taken through lines 20—20.

Preferably, tows 60 of metal coated fibers 62 are braided into a tube 66, as shown in FIGS. 19 and 20, impregnated with resin, and placed over the uncured carbon fiber prepreg tube, in the locations of the two weight pods 24 in the head, prior to molding the racquet. The metal coated fibers 62 constitute an integral part of the frame tube after molding.

Instead of braiding, the tube of metal coated fiber can be formed by weaving or other suitable processes. Thus, if desired, a prepreg formed of uncured epoxy, containing unidirectional metal coated carbon fibers, in place of uncoated carbon fibers, could be provided, and used to form the weight pods. Also, as an alternative to surrounding the prepreg tube with a tube of metal coated fibers, a flat piece of material formed of metal coated fibers can be applied to one or more selected surfaces of the prepreg tube. For example, referring to FIG. 3, the pod 24 can be formed by applying one or more pieces of metal coated fiber material over the portion of the frame surface facing the string bed.

Metal coated fibers can also be used to form the weight pod in the handle. For example, a braided tube can be placed on the inside of the prepreg tube in what will become the butt end of the handle, so that when the racquet is subsequently molded such braided tube becomes part of the frame.

Using metal coated fibers has the advantage, compared with merely adding dead weight, of strengthening the frame tube at the locations of the pods. This is particularly advantageous in the head portion of the racquet. It also is preferred over using additional carbon fiber wraps in that metal coated fibers have a greater density. Also, the process described above, in which braided material is placed over the outer surface of the uncured frame tube, has the advantage that, after molding, the surface of some of the metal coated fibers remains visible, providing a novel and pleasing visual effect.

If desired, the racquet frame itself could be made of metal coated fibers in an epoxy or other resin matrix. However, because metal coated fibers have a higher density than carbon fibers, and because the preference today is for lighter tennis racquet frames, it would be preferable, rather than making the entire frame of metal coated fiber-reinforced epoxy material, to use such material only in selected areas of the frame where it is desired to add weight. Thus, the prepreg tube for forming the racquet frame can be formed mostly of carbon fiber reinforced resin, and partly of metal coated carbon fiber-reinforced resin.

The foregoing represents preferred embodiments of the invention. Variations and modifications will be apparent to persons skilled in the art, without departing from the inventive concepts disclosed herein. All such modifications and variations are intended to be within the skill of the art, as defined in the following claims.

What is claimed is:

1. A sports racquet having a tubular frame including an enclosed head portion, defining a stringing area for supporting a string bed lying generally in a string bed plane, and a handle portion, wherein the head portion has opposing tip and throat regions and a geometric center "GC", wherein said tip region is centered about a 12 o'clock position relative to said geometric center, and said throat region is centered about a 6 o'clock position relative to said geometric center, wherein said frame includes opposed top and bottom walls and opposed side walls, said opposed side walls having outwardly facing surfaces, wherein said side walls are oriented generally perpendicular to said string bed plane, and wherein the cross-sectional distance between the outwardly facing surfaces of said side walls, at a region between 12 o'clock and 3 o'clock positions, and at a region between 9 o'clock and 12 o'clock positions, is increased to form a pod, thereby to increase locally the torsional stiffness and strength of the frame, said pods having a weight-per-unit length which is greater than the weight-per-unit length of the frame at said 9 o'clock, 12 o'clock, and 3 o'clock positions, and wherein said head portion, other than at said pods, is a lightweight, hollow tubular construction without additional weights.

2. A sports racquet having a tubular frame including an enclosed head portion, defining a stringing area for supporting a string bed, and a handle portion, wherein the head portion has opposing tip and throat regions and a geometric center "GC", wherein said tip region is centered about a 12 o'clock position relative to said geometric center, and said throat region is centered about a 6 o'clock position relative to said geometric center, wherein said frame, at each frame location, has a cross-sectional height and width, and wherein said frame, between 12 o'clock and 3 o'clock positions, and between 9 o'clock and 12 o'clock positions, has a region of increased cross-sectional width forming a pod, thereby to increase locally the torsional stiffness and strength of the frame, wherein said pods have a weight-per-unit length which is greater than the weight-per-unit length of the frame at said 9 o'clock, 12 o'clock, and 3 o'clock positions, wherein said head portion, other than at said pods, is a lightweight, tubular construction without additional weights, wherein said frame includes opposed top and bottom walls and opposed side walls, including an inside side wall facing the stringing area, wherein each wall has a wall thickness at each location on the frame, and wherein, at said pods, at least one of said side walls has a wall thickness which is greater than the wall thickness at the 9 o'clock, 12 o'clock, and 3 o'clock positions so as to have a greater weight-per-unit length.

3. A sports racquet according to claim 2, wherein said inside wall of said pods has the said increased wall thickness.

4. A sports racquet according to claim 3, wherein said pods have a weight which is between 2 and 15 grams greater than the same length of frame at the 9 o'clock, 12 o'clock and 3 o'clock regions.

5. A sports racquet according to claim 2, wherein said pods are located at the 11 o'clock and 1 o'clock regions, respectively, relative to said geometric center.

6. A sports racquet according to claim 2, wherein said pods comprise a plurality of fibers having a non-metal core and an outer metal coating.

7. A sports racquet according to claim 6, wherein said core is selected from the group consisting of carbon and glass.

8. A sports racquet according to claim 7, wherein said outer metal coating is selected from the group consisting of nickel, copper, brass, and titanium.

9. A sports racquet according to claim 7, wherein said outer metal coating is selected from the group consisting of nickel and copper.

10. A sports racquet according to claim 9, wherein said pods are formed by providing a woven or braided material of said metal coated fibers, and bonding said material on an outer surface of said tubular frame.

11. A sports racquet according to claim 7, wherein said outer metal coating is selected from the group consisting of nickel and copper.

12. A sports racquet according to claim 11, wherein said portions are formed by providing a woven or braided material of said metal coated fibers, and bonding said material on an outer surface of said tubular frame.

13. A sports racquet having a tubular frame including an enclosed head portion, defining a stringing area for supporting a string bed, and a handle portion, wherein the head portion has opposing tip and throat regions and a geometric center "GC", wherein said tip region is centered about a 12 o'clock position relative to said geometric center, and said throat region is centered about a 6 o'clock position relative to said geometric center, wherein said frame, at each frame location, has a cross-sectional height and width, and wherein said frame, between 12 o'clock and 3 o'clock positions, and between 9 o'clock and 12 o'clock positions, has a region of increased cross-sectional width forming a pod, thereby to increase locally the torsional stiffness and strength of the frame, wherein said pods have a weight-per-unit length which is greater than the weight-per-unit length of the frame at said 9 o'clock, 12 o'clock, and 3 o'clock positions, wherein said handle portion has a butt end, wherein said handle portion has a tubular, lightweight construction, and wherein said handle portion has weight-per-unit length at said butt end which is greater than in the remaining handle portion.

14. A sports racquet according to claim 12, wherein said head portion, other than at said pods, is a lightweight, tubular construction without additional weights.

15. A sports racquet according to claim 14, wherein said frame includes opposed top and bottom walls and opposed side walls, including an inside side wall facing the stringing area, wherein each wall has a wall thickness at each location on the frame, and wherein, at said pods, at least one of said side walls has a wall thickness which is greater than the wall thickness at the 9 o'clock, 12 o'clock, and 3 o'clock positions so as to have a greater weight-per-unit-length.

16. A sports racquet according to claim 13, wherein said handle portion, in said butt end, has at least one weight element to add between 3 and 40 grams of weight at the butt end.

17. A sports racquet according to claim 13, wherein said pods comprise a plurality of fibers having a non-metal core and an outer metal coating.

18. A sports racquet according to claim 17, wherein said core is selected from the group consisting of carbon and glass.

19. A sports racquet according to claim 18, wherein said outer metal coating is selected from the group consisting of nickel, copper, brass, and titanium.

20. A sports racquet according to claim 19, wherein said core is a carbon fiber.

21. A sports racquet according to claim 13, wherein said pods have a weight which is between 2 and 15 grams heavier than the same length of frame at the 9 o'clock, 12 o'clock, and 3 o'clock regions.

* * * * *